United States Patent [19]

Eaton et al.

[11] 3,949,582

[45] Apr. 13, 1976

[54] POSITIONING SERVO AND CONTROLLED MECHANISM

[75] Inventors: Homer L. Eaton, Balboa; Walter F. Felber, Newport Beach, both of Calif.

[73] Assignee: Eaton-Leonard Corporation, Santa Ana, Calif.

[22] Filed: Apr. 11, 1975

[21] Appl. No.: 567,287

[52] U.S. Cl. ..... 72/8; 72/150; 72/21; 72/307

[51] Int. Cl.[2] ..... B21D 9/05

[58] Field of Search ..... 318/612, 613, 614; 72/8, 72/9, 21, 22, DIG. 22, 149, 150, 307

[56] References Cited

UNITED STATES PATENTS

| | | | |
|---|---|---|---|
| 2,385,204 | 9/1945 | Hanna | 318/614 |
| 2,511,956 | 6/1950 | Wetzel | 318/30 |
| 3,239,735 | 3/1966 | Raider et al. | 318/614 X |
| 3,553,989 | 1/1971 | Munro et al. | 72/8 |
| 3,662,575 | 5/1972 | Zmunda | 72/21 |
| 3,761,790 | 9/1973 | Daab | 318/467 |

*Primary Examiner*—Milton S. Mehr
*Attorney, Agent, or Firm*—Gausewitz, Carr & Rothenberg

[57] ABSTRACT

A tube bending machine includes a carriage mounted rotatable chuck for grasping and positioning a length of tube with respect to the bending head of the machine. Motion of the carriage along the bed of the machine toward the bending head and rotation of the chuck relative to the carriage are both powered by a single remotely mounted motor driving an endless chain. The chain engages a drive sprocket rotatable on the carriage and gear connected to rotate the chuck. A chuck brake and a carriage distance brake are selectively energized so that when chuck rotation is prevented, the sprocket is locked to the chain and the carriage will be driven by the chain, and when carriage travel is prevented, the chuck is rotated by the chain driven sprocket. The remote motor is connected in a primary servo system to provide a closed loop drive of either the chuck rotation or the carriage travel. A secondary closed loop brake control system is provided for each of the chuck rotation and carriage travel. The position error signal of the primary servo system is compared with a signal representing actual velocity of the chuck or carriage and a second error signal proportional to the difference between the position error and the actual velocity is employed to proportionally energize the corresponding brake.

28 Claims, 9 Drawing Figures

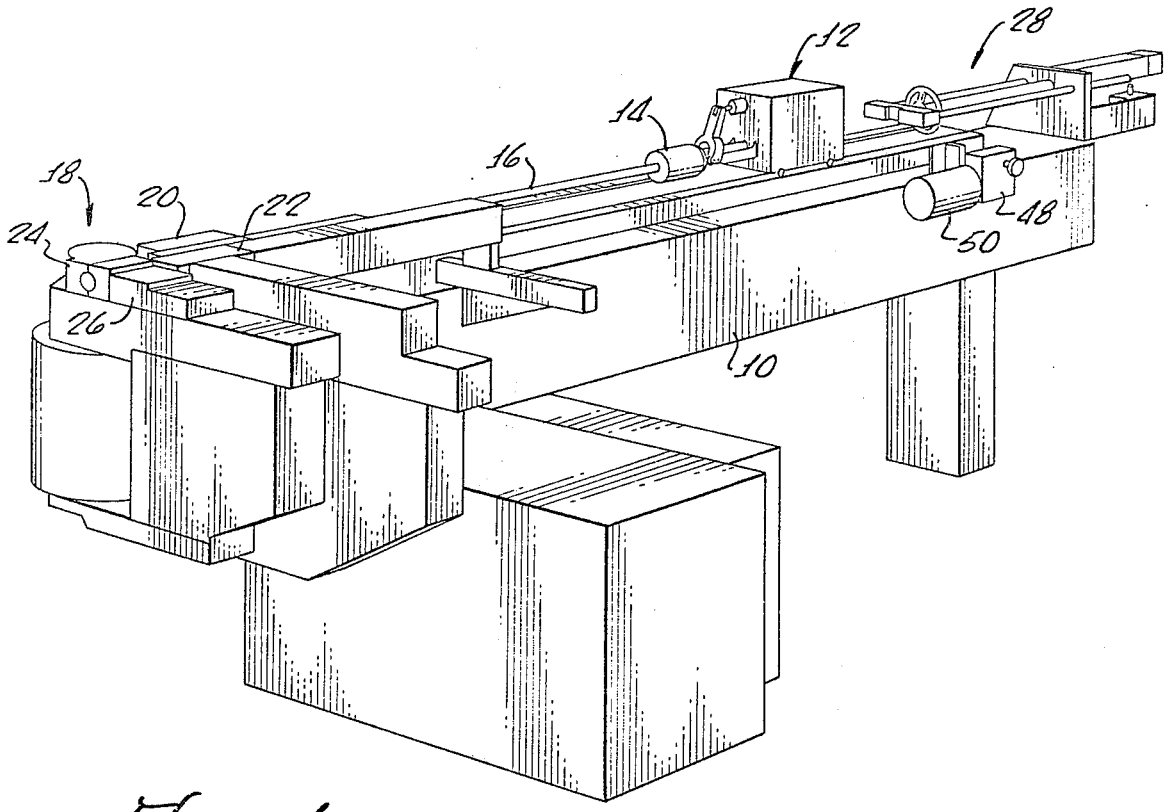
FIG. 1.
FIG. 6.
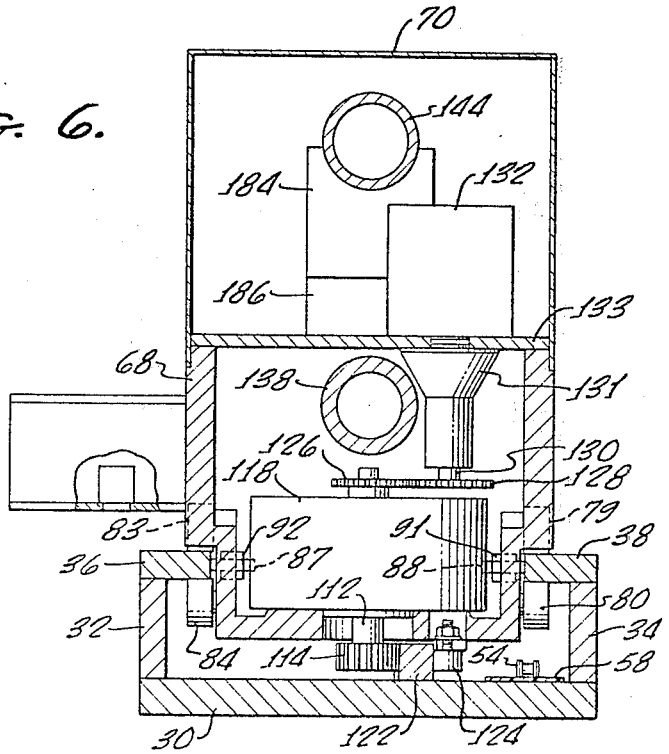

POSITIONING SERVO AND CONTROLLED MECHANISM

This application is related to a copending application of Homer L. Eaton for Tube Bending Machine and Carriage Therefor, Ser. No. 567,288 which covers a mechanism controlled by the positioning servo of the present invention, and the disclosure thereof is fully incorporated herein by this invention, and the disclosure thereof is fully incorporated herein by this reference.

BACKGROUND OF THE INVENTION

A widely employed type of tube bending machine embodies an elongated machine bed at one end of which is mounted apparatus for achieving draw bending or press bending of the tube. A multiple bend tube commonly has a number of bends located at different points along the tube and having the planes of different bends angularly shifted about the tube axis. Other variables in the bending process, whether performed by a draw or press bending, include the degree of bend and the radius of the bend. The latter two variables commonly are handled by the bending head. The position of the bend along the axis of the tube and the angular position of the plane of bend are often handled by a mechanism which grasps the tube and advances it toward the bending head to position the point of bend at the proper location with respect to dies in the bending head. The tube grasping mechanism also rotates the tube relative to the bending head to attain a selected plane of bend. Such tube handling mechanism must be simple, reliable and accurate. It must be lightweight for a fast response time, particularly where a number of bends are to be made in rapid succession by a machine that is entirely automatically controlled. Thus, many bending machines in the past have embodied separate driving mechanisms for carriage travel and chuck rotation. Heavy, expensive, screw-type drives have been employed, and these have been provided in duplicate for the driving of the chuck and the driving of the carriage. In some arrangements, one or more heavy driving motors are carried by the carriage.

Precision ball screw drives for a machine having a typical ten foot length of travel are massive and expensive. Where motors are mounted on the carriage, not only is the motor cost increased by use of plural motors, but the carriage and all supporting and driving structures must be stronger, heavier, more expensive and more difficult to precisely and rapidly control. In some prior arrangements, one motor has been employed for two drives, but these have still required duplicating of the driving connection between the motor and the several driven members.

A simple, lighter weight tension drive, such as a belt or chain, has not been employed partly because suitable drives from a chain mechanism have not been available. Another problem with the chain or belt drive is the looseness or compliance of the mechanical coupling of such an apparatus, particularly in view of the required length of carriage travel. For example, with a machine having a carriage capable of traveling ten feet, an endless chain having a length of approximately twenty feet is required to transmit the driving force from a fixed motor to the carriage. Because of the large number of joints in such a chain, the play or looseness inherent in each such joint, and the weight of the workpiece to be moved, the actual position of the driven element, the carriage or the chuck, will lag the commanded position of the driving motor shaft. Such lagging error has its greatest adverse affect during deceleration.

Although the looseness or compliance of the relatively long mechanical coupling between the driving motor and the driven carriage or chuck is more pronounced in a flexible endless loop chain drive, it also occurs in any long mechanical driving connection mechanism. A gear drive also exhibits some degree of looseness or play between successive interengaging gears of a gear chain, and an elongated shaft of a screw drive will exhibit a comparable torsional compliance as the shaft winds and unwinds about its own axis.

The longer the mechanical driving connection, the greater the looseness of the connection. A long chain drive for example, has so much play in its many interconnected joints, that when the commanded motor velocity is caused to decrease, the velocity of the driven member at the other end of the long mechanical drive, will not decrease immediately. That is, actual deceleration of the driven member lags deceleration of the remote driving motor. Such a lag will increase with increase of momentum (either mass or velocity) of the driven parts, mass of the interposed mechanical driving element (e.g. a long screw shaft, a set of interconnected gears, or a long chain), and the compliance, play, slack, or extensibility of the driving connection. Partly because of such lagging of velocity changes, adequate precision of position control has not been achieved without massive and expensive driving structures.

A belt or chain drive is preferred for a number of reasons, including the desired use of small, lightweight parts. Nevertheless, control mechanisms have not enabled such drives to exhibit satisfactory positioning of the driven member.

Conventional servo systems embody automatically reversing drive motors that enable oscillation or hunting of the servo driven system as moving parts approach the desired position, under control of an error signal. The moving parts tend to overshoot, throwing the system into reverse in which condition it may again overshoot the desired position and continue to hunt back and forth for a period of time. Various methods of minimizing such hunting have been devised, including systems involving viscous damping and error rate damping. In viscous damping, a restraining force is applied to the moving parts, but this introduces a constant error in steady state condition. In an error rate damping system, the damping force is derived from the rate of change of the error of voltage and is subject to changes in frequency of the controlling current, among other disadvantages. In any event, these damping systems are concerned with a directly driven element and apply the damping control directly to such driven element. Such damped servo systems cannot effectively control an element that is driven by a relatively loose or compliant driving connection from the servo control damped drive motor. Further, a more expensive automatically reversing motor is required.

Where braking systems have been applied for damping, they have been connected to operate directly on the motor shaft. Various controlled braking forces have been employed, including those applying braking only below certain speeds or in certain directions of motion, but none have been adequate for accurate position control.

It has been suggested that positioning may be achieved by applying a constant braking force at a certain distance from the final position, but the many variables that govern stopping distance, including variation of a manually fixed braking torque, and mass and speed of the moving parts, prevent positioning with satisfactory repeatability and precision.

Accordingly, it is an object of the present invention to afford position control of increased precision without the disadvantages of previous arrangements.

SUMMARY OF THE INVENTION

In carrying out principles of the present invention in accordance with a preferred embodiment thereof, a driven member is moved toward a preselected position and is restrained by a retarding force applied in accordance with the difference between velocity of the driven member and its distance from the predetermined position. Control is achieved whether motor or manual drive is employed. According to a feature of the invention the distance from predetermined position may also be used as an error signal for closed loop control of velocity of a driving motor which continues to drive the driven member until the predetermined position is attained. The principles of the invention are uniquely adapted for use with a dual drive mechanism in which driving of one of the several driven members is selected by differential energization of several restraining means, the latter also being employed to provide a retarding force that effects precision positioning.

BRIEF DESCRIPTION OF THE DRAWINGS

FIG. 1 is a perspective view of a tube bending machine embodying principles of the present invention;

FIG. 5 is a section taken on lines 5—5 of FIG. 3;

FIGS. 6, 7 and 8 are sections taken on lines 6—6, 7—7 and 8—8, respectively, of FIG. 5.

DETAILED DESCRIPTION

Figure 3:
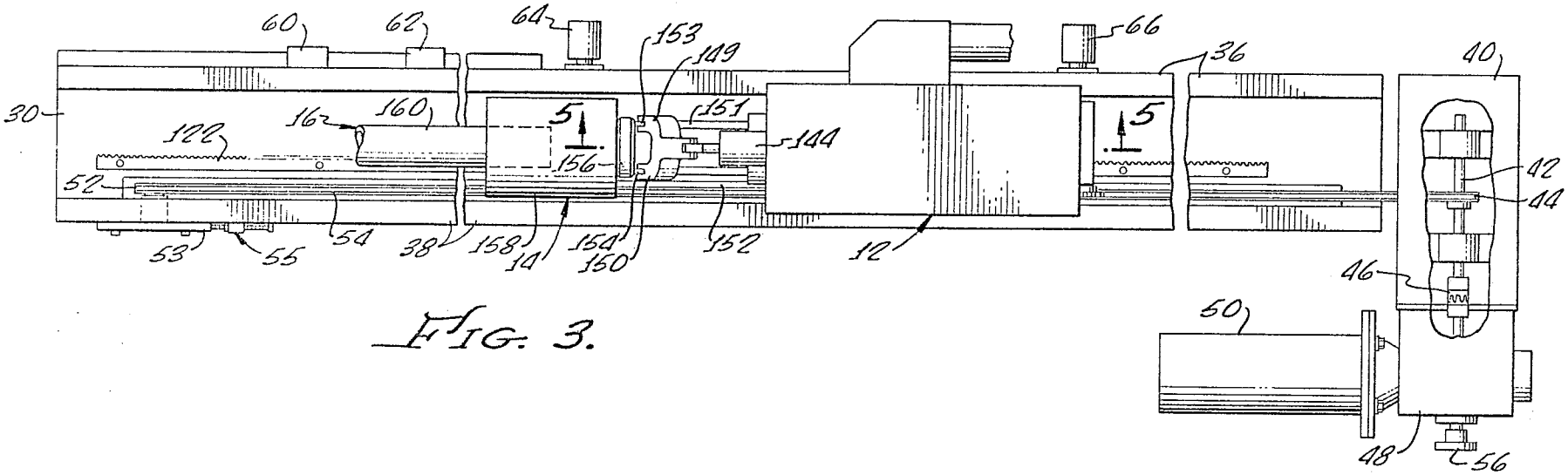
FIG. 3 is a top plan view of the machine of FIG. 1.

Illustrated in FIG. 1 is a tube bending machine that is adapted for either automatic or manual control. The general function and operation of machines of this type are well known, typical machines being described in U.S. Pat. Nos. 3,821,425, 3,808,856, 3,557,585 and 3,426,562, among others. Briefly, the machine comprises a fixedly supported bed 10 having a moving carriage assembly 12, that carries a rotatable chuck 14. The latter grips a tube 16 which is to be advanced and rotated for pre-selected positioning with respect to dies carried by a machine bending head, generally indicated at 18. Principles of the present invention may be employed in bending machines using various types of bending, such as, for example, rotary, draw or press bending. Draw bending apparatus is schematically illustrated in FIG. 1, for purposes of exposition only, as including a press die 20, a wiper die 22, a rotatable die 24 and a clamp die 26 rotatable together with the bend die. Carriage assembly mounting and construction, and particularly the drive and control therefor, embody principles of the present invention which will be described in further detail hereinafter.

For bending operation, the carriage advances the tube 16 and the chuck rotates the tube for positioning with respect to the dies. The press and wiper dies 20, 22 clamp a portion of the tube behind the bend and both the clamp die and bend die are rotated about a substantially vertical axis, in the illustrated arrangement, to effect the bend. Thereafter, the dies are withdrawn from the tube, the carriage is advanced and the chuck rotated to properly position the tube both longitudinally and rotatably for the next band. A conventional mandrel is inserted in the tube prior to each bend, properly positioned with respect to the area to be bent and thereafter withdrawn by means of a substantially conventional mandrel extracting mechanism 28 mounted at the rear of the bed 10.

Figure 2:
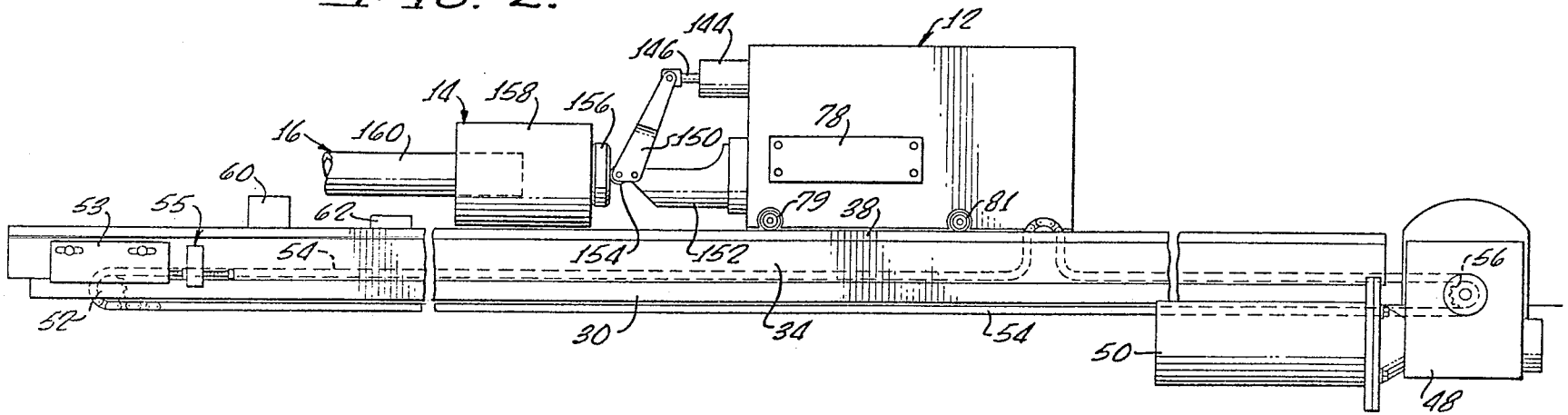
FIG. 2 is a side elevational view of the bed of the machine of FIG. 1.
Figures 5, 7, 8:
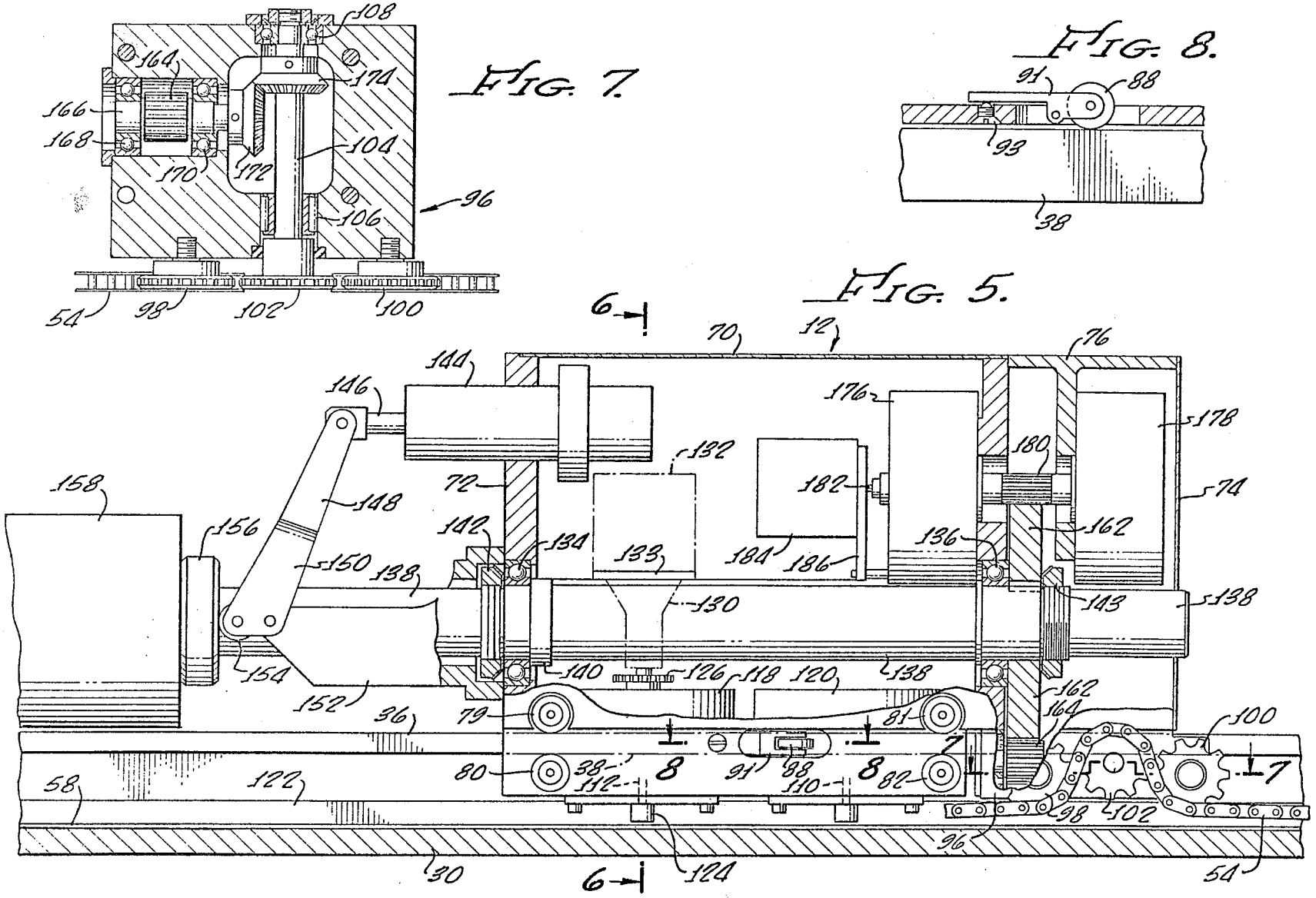

In the illustrative embodiment of the present invention, the machine bed 10 carries a substantially U-shaped elongated rail assembly (FIGS. 2, 3 and 6) having a rigid substantially horizontal web 30, first and second upstanding sidewalls 32, 34, and oppositely disposed and inwardly projecting flanges 36 and 38 that form rails or tracks for the carriage. A shaft housing (FIG. 3) mounted at the rear of the machine bed rotatably carries a short carriage drive shaft 42 on which is pinned a carriage sprocket 44. Shaft 42, having a length only slightly greater than the width of the rail assembly, is driven via a carriage drive coupling clutch 46 and gear box 48 from a reversible direct current motor 50 which, together with the gear box, is fixedly mounted upon the side of the machine bed. An idler sprocket 52 is journalled at a forward end of the wall 34 of the rail assembly and a carriage driving roller chain 54 is entrained in an endless loop over the idler sprocket 52 and the carriage drive sprocket 44. Idler sprocket 52 is movably mounted to the rail assembly by means of a sprocket adjustment bracket 53 that is adjustably positioned by a screw and nut arrangement 55 for adjusting chain tension. Carriage drive shaft 42 has a manually controllable knob 56 that enables manual operation of the chain when motor 50 is decoupled from the drive shaft by pulling the knob outwardly. An elongated strip of chain bearing tape 58 (FIGS. 5, 6) is fixed to the rail assembly web 30 directly beneath the upper run of chain 54 to minimize wear on the rail assembly and chain. A forward carriage stop 60 and a magnetic carriage position reference device 62 are mounted along the rail assembly track. Also mounted to the rail assembly are cable rollers or rotatable supports 64, 66 for movably supporting electrical wiring that connect various elements on the movable carriage to relatively fixed control apparatus.

CARRIAGE

Carriage assembly 12, (FIGS. 5, 6) includes a carriage housing in the form of a casting 68 having a top cover 70, a front cover 72, and a rear cover 74. An upper gear cover 76 extends from top cover 70 to provide access to certain enclosed components. A side access cover 78 provides access to other parts contained within the carriage housing.

The carriage rotatably carries two pairs of mutually opposed and vertically spaced rollers 79, 80, 81 and 82 on one side and similar pairs of mutually opposed and vertically spaced rollers including those indicated at 83, 84, on the other side. As best seen in FIG. 6, the rollers of each pair are spaced apart by a distance just greater than the thickness of track members 36, 38 which are respectively interposed between rollers of pairs of rollers on either side of the carriage assembly. The carriage housing also carries a pair of side loading rollers 87, 88 which are mounted for rotation about a vertical axis in respective levers 91, 92. The side loading levers 91, 92 (FIG. 8) are pivotally urged to press the side loading rollers against the facing edges of the respective track members 36, 38 to enhance the stability of the roller mounting of the carriage upon the rail assembly. Adjustment of outward roller pressure is achieved by screws such as screw 93 which is threaded in the carriage and bears against lever 91.

A carriage drive gear box 96 (FIGS. 5, 7) fixed to the underside of a rear portion of the carriage housing, rotatably mounts a drive sprocket assembly comprising first and second idler sprockets 98, 100 journalled upon mutually spaced parallel horizontal axes on either side of a carriage drive sprocket 102 that is pinned to a drive sprocket shaft 104 journalled in needle bearings 106 and ball bearings 108 carried by the carriage drive gear box 96. Roller chain 54 is entrained over drive sprocket 102, extending between the latter and the idler sprockets 98, 100, which thus help to hold the chain in operative engagement with the drive sprocket.

Rotatably journalled in the carriage housing about a vertical axis, are a pair of longitudinally spaced pinion shafts 110, 112, fixedly carrying, at the lower ends thereof, pinion gears 114, 116, respectively. The pinion shafts are fixed extensions of a pair of carriage distance brakes 118, 120, which are fixed to the carriage housing and capable of electrical operation to prevent rotation of the pinions and pinion shafts, as will be more particularly described hereinafter. Pinions 114, 116 engage a rack 122 (FIGS. 3, 6) that is fixedly carried by rail assembly web 30 and extends for substantially the entire length of carriage travel. The pinions are held in firm operative engagement with the rack by means of a roller 124 rotatably carried at the bottom of the carriage housing and depending therefrom into engagement with the back surface of the rack 122. The brake or pinion shaft 112 carries a gear 126 at its upper end which engages with a gear 128 that is fixed to one end of an input shaft 130 of a carriage distance encoder 132. Encoder 132 is a conventional position pickoff transducer such as an ACCU-CODER, Model No. 716, manufactured by Encoder Products of Sandpoint, Idaho. The position transducer produces an electrical pulse for each increment of angular displacement of its input shaft, and accordingly, one output pulse for each increment of motion of the carriage along the rail assembly. In an exemplary mechanization each encoder pulse represents 0.01 inches of carriage travel or (for the chuck rotation encoder described below) 0.1°. Encoder input shaft 130 is journalled in a vertically extending encoder shaft housing 131 which is fixed to an encoder mounting plate 133 carried by the carriage housing sidewalls.

Journalled within the carriage housing on front and rear bearings 134 and 136, and extending horizontally through the carriage, is a rigid, hollow carriage shaft 138 that is locked against longitudinal motion relative to the carriage by means of a collar 140 fixed to the shaft 138 and bearing lock nuts 142 and 143. An hydraulic cylinder 144 powers a cylinder rod 146 that is pinned to bifurcated arms 149, 150 of a collet lever 148. The arms 149, 150 are respectively pivoted on arms 151, 152 (FIG. 3) of a collet lever bracket that is fixed to the front of the carriage housing. Lever arms 149 and 150 carry rollers 153, 154 that bear against an axially shiftable thrust bearing 156 mounted upon the carriage shaft 138. Threaded upon the forward end of the rotatable carriage shaft 138 is a conventional chuck assembly 158 having a radially contractable arbor adapted to be inserted over a tube carried by the chuck and contracted by movement of the thrust bearing from an open position to a tube locking position. Although many different types of remotely operable chucks are known and may be employed, in a preferred embodiment of the invention the chuck comprises a Jacobs rubberflex collet chuck having inner and outer cylindrical members with interfitting tapers such that forward motion of thrust bearing 156 will drive the outer chuck cylinder forwardly (to the left in FIG. 5) and force the contractable inner cylinder to be radially inwardly compressed to grasp an end of the tube inserted therein.

Keyed to the carriage shaft 138 is a chuck rotation power gear 162 (FIG. 5) that engages a pinion gear 164 fixedly carried on a stem pinion shaft 166 (FIG. 7) that is journalled in the carriage drive gear box by means of bearings 168, 170. Stem pinion shaft 166 fixedly carries, at its inner end, a mitre gear 172 which meshes with a mitre gear 174 fixed to the drive sprocket shaft 104.

Fixedly mounted to the carriage housing are first and second chuck rotation brakes 176, 178 (FIG. 5) having coaxial horizontally extending input shafts which are fixed in common to a pinion gear 180 that meshes with the chuck rotation power gear 162. One end of the input shaft of brake 176, is connected to an input shaft 182 of a rotation encoder 184 fixedly carried upon an encoder mounting plate 186 which itself is mounted to and carried by rotation brake 176. Encoder 184 is identical to encoder 132 and provides a position pickoff transducer that signals rotation position (actually increment of changes of angle in the described embodiment) of the carriage shaft, chuck, and tube carried thereby. All of the four brakes, the chuck rotation brakes 176, 178 and the two carriage distance brakes 118, 120, are identical. Such proportional brakes are electrically operated to provide a selectively variable proportional braking torque. The braking torque applied is directly proportional to the magnitude of an electrical brake driving signal that is applied to the brake in response to a brake control error signal to be described below. Proportionally operable electro-magnetic brakes such as the Sofstep brake, Part. No. 97570-190 made by Lear-Siegler Corp. are exemplary of those that are preferred in practice of this invention.

MECHANICAL OPERATION

Initially a tube to be bent is manually inserted in the chuck and chuck operating cylinder 144 is actuated to lock the chuck upon the tube. With the tube grasped in a chuck, the carriage is then moved until it abuts the carriage stop block 60 which thus provides a reference for the carriage position and for zeroing position command registers, when employed. The carriage is then moved rearwardly and bending operations may be commenced. Upon commencement of the bending, the carriage is moved to the first commanded position. No chuck rotation is required for the first bend since the first bend may be made in the initially chosen rotational orientation of the tube. A suitable mandrel is inserted through the carriage shaft, through the tube that is grasped in the chuck, and into and through a portion of the tube that lies at the machine bending head. The bending head dies are operated to grasp and bend the tube during which time the carriage and rotation brakes are de-energized. The carriage brakes are de-energized during the draw bending since this bending operation will operate to pull the tube toward and along the bending die as the bend is made, drawing the carriage assembly along with the tube. Having made the first bend, the dies are moved to release the tube, the chuck brakes are locked and the carriage assembly advanced to the position the tube at the point of next bend. The carriage brakes are now locked and the chuck is rotated to a predetermined angular position as determined by the plane of the next bend and the commanded angular position. The dies are then separated to again grasp the tube rearwardly of the bend die. The carriage and chuck brakes are released and the next bend is completed. The described sequences may be carried out by hand if necessary or desirable or may be entirely automatically programmed by methods and apparatus well known in the art. Position control of both carriage and chuck are achieved by the positioning servo described in detail below.

Figure 4:
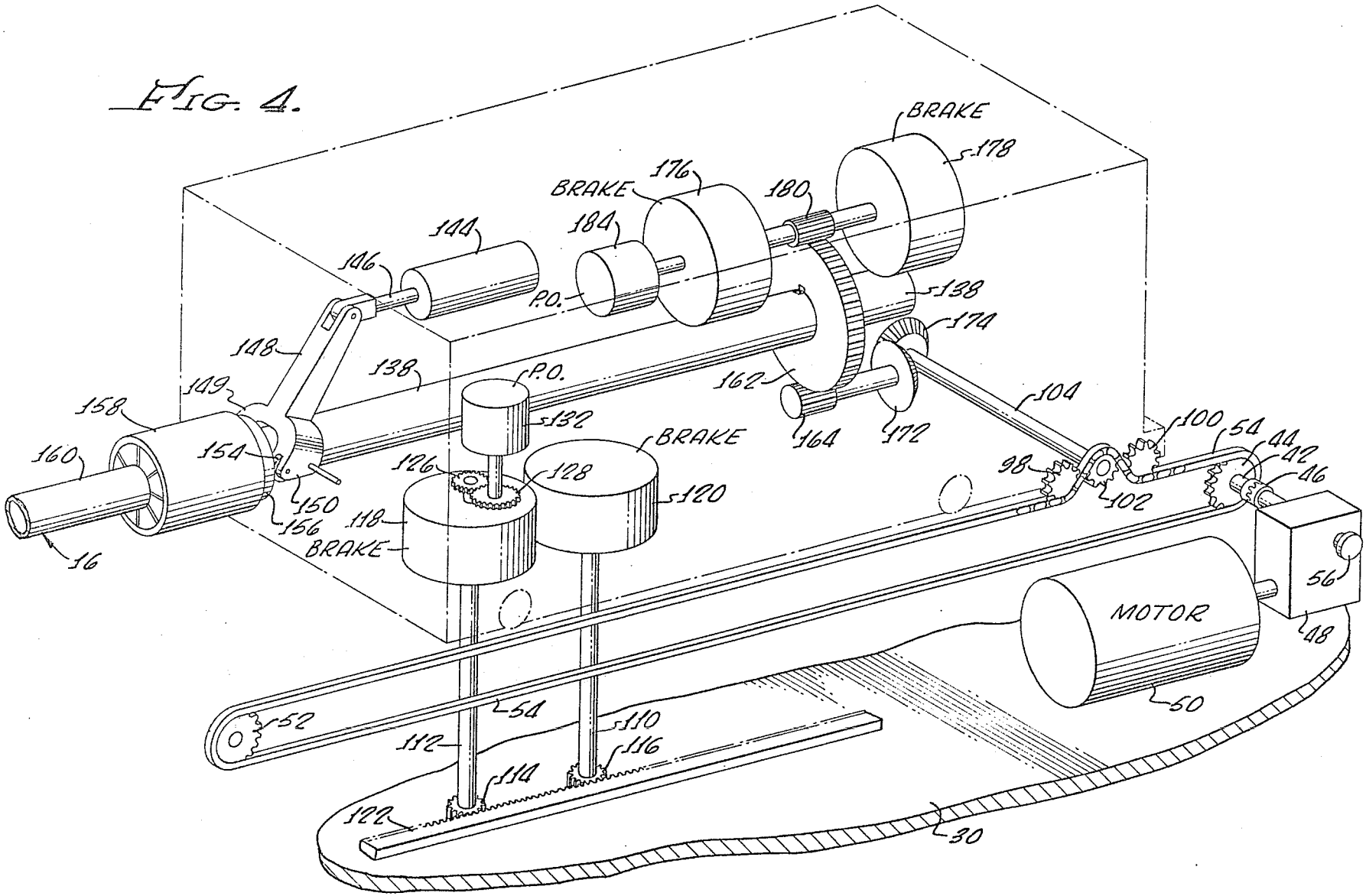
FIG. 4 is a schematic illustration of the functioning parts of the carriage and chuck drive mechanism, illustrating the braking arrangement for drive selection and position control.

A schematic mechanical structure is illustrated in FIG. 4 to facilitate understanding of the selective drive operation. The arrangement enables the tension member, chain 54, to operate via a selective coupling means (which includes the positioning servo brakes) to selectively cause the tension member to move (a) the carriage along the track, (b) the chuck about its rotation axis, or (c) both of (a) and (b). Nevertheless, for operating the described bending machine it is not necessary to drive both carriage and chuck at the same time.

For driving of the carriage assembly along the rail assembly, chuck rotation brakes 176 and 178 are energized to lock gear 180 and rotation power gear 162, and thus lock the drive sprocket 102 against rotation with respect to the carriage. With the rotation brake and drive sprocket 102 locked, chain drive sprocket 44 may be rotated by operation of motor 50 or by hand (directly grasping and pulling the tube 16 or the carriage assembly) when the motor is disconnected by means of disengagement of clutch 46. Thus, chain 54 is driven, but cannot rotate the locked carriage drive sprocket 102. Accordingly the entire carriage assembly is moved along with the chain relative to the rail assembly. As the carriage moves along the rail assembly, pinions 114, 116 are moved relative to the rack 122 and thereby rotated to operate distance pickoff 132. The latter provides an output signal in the form of a train of electrical pulses representing increments of carriage travel. Distance brakes 118 and 120 are not energized at this time but may be energized when the carriage approaches a desired position as more particularly described below in connection with the description of the positioning servo. Nevertheless, for the purpose of mechanical drive selection of carriage motion, brakes 176, 178 are fully energized and brakes 118, 120 are deenergized except as employed to stop carriage motion.

When the carriage has attained its desired position, the carriage may be locked and a tube gripped in the chuck 158 is rotated so as to provide a selected plane of bend. Thus, distance brakes 118 and 120 are fully energized to lock pinions 114 and 116 and prevent motion of the carriage along the rail assembly. Chuck rotation brakes 176 and 178 are de-energized, whereby rotation of the chain drive sprocket 44 by motor 50 will again drive the endless chain 54. Now, however, because brakes 176, 178 are de-energized and brakes 118, 120 are energized, the carriage drive sprocket 102 will rotate in its bearings relative to the carriage housing. Rotation of sprocket 102 drives gears 174, 172 and 164 to thereby drive chuck rotation power gear 162. Accordingly, the carriage shaft 138 is rotated to rotate chuck 158 and a tube 16 grasped thereby. Rotation of power gear 162 drives pinion 180 to thereby drive the input shafts on both brakes 176 and 178 and also to drive the input shaft of pickoff 184. The latter, accordingly, provides an output signal representing increments of chuck rotation.

Thus, it will be seen that one drive member, chain drive sprocket 44, is coupled to drive either the chuck 158 or the entire carriage assembly, and the brakes comprise a selector arrangement for selectively differentially restraining chuck rotation and carriage motion (as by braking one and not braking the other, for example). When the two driven members (carriage assembly and chuck) are differentially restrained, the response to drive member 44 of that one of the driven members having the lesser restraint is increased. Although both the carriage motion and chuck rotation may be achieved simultaneously in relatively differing amounts according to the degree of energization of the respective brakes, in the described bending machine the two motions, the carriage motion and chuck rotation, take place alternatively. That is, chuck rotation is prevented while the carriage is moving and carriage motion is prevented while the chuck is rotated. When the tube is grasped by the bending dies both sets of brakes are de-energized.

POSITION CONTROL

Position control of the apparatus, that is, control of both the actual positioning of the carriage along the rail assembly and of the rotation of the chuck, is achieved by means of a unique braking control circuit that operates regardless of the nature of the drive imparted to the carriage or chuck. It will be recalled that the carriage and chuck may be driven from the motor 50 via the drive chain and connected mechanism. Alternatively, by disengaging the motor by operation of clutch 46, the carriage and chuck may be moved manually, for example, by grasping a tube clamped in the chuck and pulling the assembly to a selected position, or by rotating the tube and thus the chuck to a desired position of angular rotation. Further, because of the considerable slack in the long chain, the carriage or chuck may be moving solely under the influence of its own momentum when the motor is connected to drive the mechanism but has been rapidly slowed so that carriage or chuck velocity is greater than the desired motor velocity. Therefore, regardless of the nature of the driving force, whether motor drive, momentum or manual, once a desired position (a point along the rail or a desired displacement) has been set into the apparatus, the positioning control will positively and precisely stop the carriage motion or the chuck rotation, as the case may be, upon attaining the selected position.

Uniquely, the very same braking mechanism employed for selection of carriage or chuck drive is employed for the precise position control. Thus, when driving the carriage, the chuck brakes are tightly locked. The carriage brakes, which are initially de-energized to allow rapid position approach, are selectively energized. Conversely, when rotating the chuck, the carriage brakes are continuously locked and the chuck brakes are selectively energized as the desired rotational chuck position is approached.

Briefly, a position error signal is generated that indicates the distance (linear or angular) between a position to which the carriage or chuck is to be moved and the actual position of the carriage or chuck, respectively. The controlling brake (the carriage brake when carriage motion is being controlled and the chuck brake when chuck motion is being controlled) is then energized in response to the position error signal and an actual velocity signal. The brake is caused to apply a braking force that is substantially proportional to the different between the actual velocity signal and the position error signal.

Figure 9:
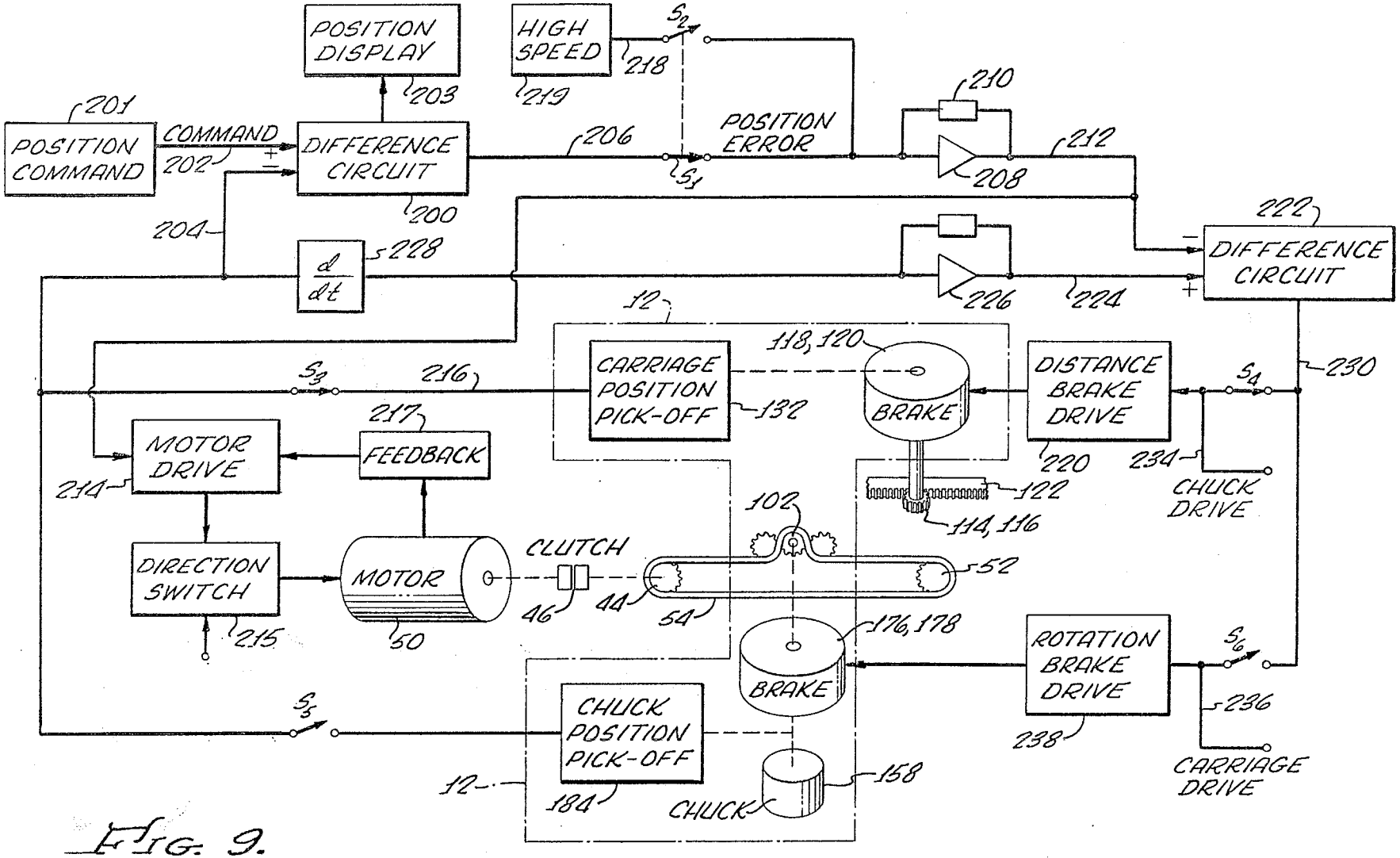
FIG. 9 illustrates a servo positioning system embodying principles of the present invention as applied in a multiplexing operation to drive both the chuck and carriage.

Illustrated in FIG. 9 is a block diagram of the novel positioning system, made up of conventional components, and employed in a time sharing arrangement for control of both carriage and chuck position.

Control of both carriage and chuck position are substantially identical and we shall first consider carriage position control. A difference circuit 200 receives from a source 201 of position command a first input; in the form of a command signal on a line 202, that represents a position to which the carriage is to be driven. The different circuit receives as a second input, on a line 204, a feedback signal representing the actual position of the driven member, the carriage in this case. It may be noted that the control system can be mechanized either by means of standard commonly available analog or digital components, as is well known in the art. Where a digital mechanization is employed, the difference circuit is preferably a digital storage register into which a commanded position number is inserted, either automatically, from the output of a computer, or manually by operator control of buttons on an input console, as generally represented by the position command source 201. In such a digital arrangement, the feedback signal representing actual position on line 204 is a series of pulses, each of which represents an increment of travel and each of which decreases the commanded position number stored in the circuit or storage register 200 by a single bit or unit of distance. Accordingly, an output of the different circuit on line 206 is a position error signal in the form of an encoded number proportional to the distance between actual and commanded position. This error, together with the commanded position, are displayed in position display 203 for monitoring of the operation.

The position error signal on line 206 is fed via a switch $S_1$ to an operational amplifier 208 having an adjustable gain controlling feedback circuit 210. In a digital mechanization, a digital to analog converter (not shown) is interposed between the output of the different circuit and the input of the amplifier 208. Gain of amplifier 208 is adjusted so that its output, on a line 212, is a DC voltage having a magnitude that is directly proportional to a desired motor speed. This motor speed signal on line 212 is fed to a conventionaal motor drive circuit 214 that provides a driving voltage via a motor reversing switch 215 for the DC motor 50 previously described. A standard motor velocity feedback 217 is provided such that motor 50 is driven at a speed proportional to the voltage on line 212.

With the clutch 46 engaged, the motor rotates chain drive sprocket 44 to thereby pull the chain 54 along the rail assembly. Because the carriage is now being controlled, chuck brakes 176, 178 are fully energized to lock the carriage drive sprocket 102 against rotation to thereby pull the entire carriage assembly with the chain along the rails. Carriage brakes 118, 120, at this time, are de-energized. The carriage assembly is indicated in FIG. 9 by a box 12, depicted in phantom lines.

As the carriage travels along the rail assembly, the carriage position pickoff 132 provides a position feedback signal on line 216 which is fed via a multiplexing switch $S_3$ to the second or feedback input of different circuit 200.

To enhance the speed of motor driven approach to the desired position, the carriage is initially driven at high speed from a steady state, fixed voltage provided on an input line 218 from a high speed control source 219 and fed to amplifier 208 via a switch $S_2$. Thus, switch $S_2$, between line 218 and the input of amplifier 208, is initially closed and the corresponding switch $S_1$, ganged with switch $S_2$, is initially open, whereby a relatively high level steady state signal is applied to drive the motor at a constant high speed. When the distance between the desired position and the actual position of the carriage has decreased to a preselected value, such as 4 inches, for example, switches $S_1$ and $S_2$ are simultaneously operated to open $S_2$ and close $S_1$, thereby to place the motor under control of the decreasing position error signal provided from the difference circuit 200. The operation of ganged switches $S_1$ and $S_2$ may be achieved either manually, by an operator monitoring the operation or automatically, by a conventional circuit logic which monitors the position error and provides a switch operating signal when the position error decreases to a value representing the desired distance at which proportional braking operation is to be initiated.

It will be observed that the arrangement described to this point is a motor driving servo in which a motor is operated at rate or velocity proportional to a sensed position error. However, it will be also observed that particularly because of the long, compliant tension drive of the carriage, changes in velocity of the carriage will not precisely follow changes in velocity of the driving motor 50. As the carriage approaches the desired position, the motor 50 is caused to slow down in proportion to the decreasing position error. Decreasing velocity of the motor causes a decreasing pull upon the tension connecting member, but momentum of the carriage causes the latter to continue at a relatively higher velocity. Thus, the lagging of velocity changes of the driven carriage with respect to velocity changes of the driving motor is greatly enhanced because of compliance of the connecting chain.

For precise positioning, a restraining force is applied to the carriage to cause its velocity to more closely follow the velocity of the driving motor and, further, to ensure that the carriage will stop precisely at the commanded position (which is represented by the signal on command input line 202). To this end, the carriage brakes 118, 120 are driven by a distance brake drive circuit 220 that is energized via a multiplexing switch $S_4$ from the output of a second or brake control difference circuit 222. A first input to circuit 222 is provide from line 212 at the output of the speed adjusting amplifier 208. This first input to the brake control difference circuit 222, as previously mentioned, is directly proportional to the position error of the carriage. A second input to difference circuit 222 is provided on a line 224 in the form of an actual velocity signal, a signal that is proportional to the actual velocity of the carriage. The velocity signal is provided from the output of a high gain operational amplifier 226 which in turn receives as its input the output of a circuit 228 which effectively differentiates the carriage position pickoff signal on line 216.

In an analog system, circuit 228 may be a conventional analog differentiating circuit such as a resistance capacitor circuit or other differentiating circuit. In a digital arrangement, where the carriage position pickoff signal is a series of pulses each representing an increment of distance travelled, circuit 228 may simply provide an output signal proportional to the time interval between pulses or the time required for occurrence of a selected number of such position pickoff pulses, which is of course, directly proportional to the rate of change of position (e.g. velocity). The circuit 228 provides a convenient way to obtain velocity information from the same transducer 132 that measures position. Obviously a second transducer, directly generating a velocity signal, may be employed alternatively.

Difference circuit 222 is a conventional resistive summing circuit, receiving an input of a first polarity from amplifier 208 and an input of opposite polarity from amplifier 226 whereby the output of the difference circuit, on line 230, is a brake control error signal that is proportional to the difference between actual velocity of the carriage and the carriage position error, such carriage position error itself being directly proportional to the commanded motor velocity. The brake control error signal on line 230, is fed via a multiplexing switch $S_4$ and via distance brake drive circuit 220 to energize both distance brakes 118, 120. These brakes, therefore, are caused to exert a braking torque that is directly proportional to the magnitude of the distance brake control error signal. During carriage drive selection, there is no signal on a second input line 234, which is employed only for chuck drive selection.

Various types of controllably energized brakes may be employed. In a preferred embodiment, all of the brakes, both distance brakes and both chuck brakes, are of the type described above. These are magnetic particle brakes which are electrically operated to exert a braking force directly proportional to the magnitude of the applied signal. When the distance brakes are energized, pinions 114, 116 retard the carriage motion by their engagement with the fixed rack 122. With the described brake control of carriage position, the distance brakes are energized only when the signal on line 224 is greater than the signal on line 212. When the signal on line 212 is greater, the brakes exert no retarding force on the carriage. As motor speed decreases and carriage speed decreases at a lesser rate, there is a velocity error equal to the difference between commanded motor velocity and actual carriage velocity. This velocity error is also proportional to the difference between the position error and the actual carriage velocity. A brake control error signal proportional to this velocity error (and proportioned to the difference between actual velocity and position error) is applied to the brakes and thus a braking force is applied having a magnitude in direct proportion to the velocity error. As the velocity error decreases, the retarding force applied by the brakes decreases. As the carriage approaches a position at or substantially at the desired position, as defined by the command signal on line 202, the position error becomes zero or very small. It may be noted that the gain of the closed loop brake controlling circuit, particularly as defined by the gain of amplifier 226, is quite high and considerably greater than the gain of the rate servo drive of motor 50. Accordingly, even a small actual velocity of the carriage, when the latter is at or near its commanded position (and position error is zero or very small), will result in a relatively large brake control error signal and thus cause a large braking force, whereby to ensure stopping of the carriage precisely at the commanded position, without overshoot.

The operation of the two servo systems for carriage control, the motor driving servo system and the position controlling closed loop brake servo system, have been described in a situation where the carriage is driven by the motor. As previously noted, the position controlling brake servo will operate regardless of the nature of the carriage drive. Thus, the clutch 46 disengaged, the motor may still be driven as previously described by means of the position error signal on line 212, but such motor drive has no effect upon the chain or carriage. Nevertheless, a desired position may still be inserted into the difference circuit 200 via line 202 and the carriage pisition pickoff 132 will still operate to enable the difference circuit and amplifier 208 to provide the above described position error on line 212 (to drive the motor but not the chain 54 or carriage). Now, with the motor and gear box 48 disconnected, the carriage may be moved by hand. One may simply push the carriage along or grasp the tube locked in the carriage chuck and pull the entire assembly toward the position defined by the command position that has been inserted into difference circuit 200. In this mode of operation, the closed loop brake control will operate just as previously described in connection with the driving of the carriage by the motor. It will stop the carriage precisely at the commanded position. The brake control loop depends only upon position error and actual carriage velocity as sensed by pickoff 130 and velocity generating differentiating circuit 228. Whether or not the position error is employed to provide a driving force for the carriage has no effect upon the operation of the brake controlling circuit.

When the chuck is being driven, the carriage is locked in position. In this mode, multiplexing switches $S_3$ and $S_4$ are opened to disconnect the carriage position pickoff and to disable the connection between the distance brake drive and the difference circuit 222. At such time, a chuck drive signal is applied on a line 234 to the distance brake drive to fully energize the distance brakes and thus maintain the carriage locked in position when chuck drive is selected. As described above, when the distance brakes 118, 120 are not employed for mechanical selection of chuck rotation, these very same distance brakes are employed for precise carriage positioning as part of the brake control servo. Similarly, when the chuck rotation brakes 176, 178 are not employed for mechanical selection of carriage motion, they are employed for precise chuck positioning as part of the chuck brake control servo. Thus, for chuck rotation, multiplexor switches $S_3$ and $S_4$ are both opened and corresponding multiplexor switches $S_5$ and $S_6$ in the chuck brake control are closed. For both chuck rotation and carriage position a number of the circuit elements are employed in common, including difference circuit 200, switches $S_1$ and $S_2$, amplifier 208, difference circuit 222, amplifier 226, velocity circuit 228, motor drive circuit 214, 215 and motor 50, together with the mechanical driving components.

For chuck rotation, the position command on line 202 represents a desired angular position, expressed in degrees of rotation. Initially, switch $S_1$ is open and switch $S_2$ is closed to feed a high level motor drive signal to amplifier 208 and thence, via motor drive 214, 215, to the motor 50. With clutch 46 engaged, the motor drives chain drive sprocket 44, chain 54, and carriage drive sprocket 102. The carriage motion is now prevented because distance brake drive 220 receives a high level chuck drive signal on line 234 to fully energize the distance brakes 118, 120. Accordingly, sprocket 102 rotates on its journals in the carriage and, by mechanism previously described, rotates chuck 158. Chuck position pickoff 184, which is identical to the carriage position pickoff, provides a train of output pulses each of which represents an increment of chuck rotation. This chuck rotation signal is fed via closed switch $S_5$ to the second input of difference circuit 200. The latter provides at its output 206 a position error directly proportional to the angular distance between the desired position of chuck rotation and the actual position of the chuck rotation. When this position error decreases to a predetermined angle, such as 40° for example, switches $S_2$ and $S_1$ are operated to disconnect line 218 and connect the position error on line 206 to the input of amplifier 208, whereby motor 50 is now controlled in a servo loop to be driven at a speed directly proportional to the computed chuck angular position error.

The chuck position pickoff signal is also fed to the velocity circuit 228 which provides an output signal that is now indicative of the actual rotational velocity of the chuck. This velocity indicating output signal, fed via high gain amplifier 226, provides one input to the brake control difference circuit 222 which has as its other input the chuck angular position error signal on line 212. A rotation brake error signal is now fed to a rotation brake drive circuit 238 which operates as previously described in connection with operation of the carriage distances brakes. Circuit 238 energizes the chuck rotation brakes 176 and 178 to cause these to apply a braking torque proportional to the rotation brake error signal. For selection of carriage drive a carriage drive signal on a line 236 energizes the rotation brake drive 238 to fully energize the rotation brakes to prevent rotation of drive sprocket 102. However, no signal is applied on line 236 when chuck drive is selected.

The chuck braking loop operates in the same manner as the carriage braking loop and tends to decrease the difference between chuck rotational velocity and chuck position error (commanded motor velocity). In a manner similar to that described above, the chuck position error is substantially zero when the chuck is at or nearly at its desired position, wherefor a strong braking force is applied to the chuck power gear 162 if there should still be any chuck velocity remaining.

Again, this position control will operate when the chuck is being rotated from motor 50, clutch 46 and chain 54, and also will opertate when the clutch 46 is disengaged and the chuck is rotated manually, as by rotating a tube held in the chuck. For manual rotation of the chuck, clutch 46 is disengaged. One manually rotates the chuck, the carriage shaft, and the carriage drive sprocket 102 together with chain 54 and its sprockets 44 and 52, but the motor and gearing within gear box 48 are not moved. Similarly, when moving the carriage assembly by hand with chuck brakes 176, 178 locked, carriage drive sprocket 102 is locked to the chain and draws this along its path of travel about sprockets 44, 52, but the motor and its gear box remain at rest. A significant aspect of the described position servo is the fact that the brakes of the servo loop are only energized for servo purposes in response to carriage (or chuck) velocity and position error. Further, the brakes are always energized (when brake servo control is employed) from a simple brake control difference circuit 222. A comparison is made between the distance of the driven member from the desired position and it actual velocity and the brakes are energized in proportion to this difference. Thus, when position error is large (the driven member is relatively far from its desired position) its velocity also may be large without calling for any braking, which would be inefficient at large position errors. On the other hand, as the driven member approaches its desired position, the brake control servo monitors velocity and enforces a concommittantly decreasing speed. Thus it operates efficiently over a wide range of velocities.

It is not desirable (nor necessary with the described brake control servo) to calculate a predetermined braking distance because this distance will vary according to repeatability of braking forces, mass of the driven member (which varies with different diameter and lengths of tube), wear of the parts and the like. The present arrangement simply computes the difference between the specified quantities and applies a proportional braking force.

Not only is the brake control servo itself of unusual simplicity and effect but is directly adapted for use in combination with a servo motor drive system and actually employs as one of its inputs the position error of such a servo motor drive system. This feature facilitates operation of the braking servo while the motor continues to drive. It is not necessary to disconnect the driving force and thus the possibility of stopping the driven member before it reaches its desired position is avoided.

The described position controlling brake servo not only avoids premature stopping, but it also avoids overshoot. This servo enables use of a less expensive velocity controlled motor 50 because the latter need not be automatically reversed as would be required by a conventional "hunting" servo, even with anti-hunting circuitry. The nature of the described braking servo ensures that the driven member will be precisely stopped at the commanded position (within the unit distance represented by one pulse of the pickoff transducer). There is no overshoot and thus no need to reverse the motor for return to a position that has been passed. The motor, of course, is reversible to return the carriage toward the rear of the machine bed, but this is achieved by the externally controlled reversing switch 215.

Still another unique feature of this positioning system, particularly as applied to a dual mechanical drive, is the fact that it makes use of braking components required for other purposes in the mechanism, components which otherwise would lie idle when only one drive takes place. Thus, not only is the precise positioning control unique individually, but is is adapted to cooperate with the selective mechanical drive to provide a synergistic combination wherein the braking allows use of a common elongated tension or chain drive (affording mechanical selection of one or the other of two driven members) and wherein this same braking, as employed in the precision positioning loop overcomes problems inherent in the long complaint tension drive itself.

Nevertheless, dual use of the brakes, for both drive selection and positioning control, is not required, since the described positioning control servo is clearly not limited to use in a tube bending machine nor to use in a machine having a brake operated drive selection.

There have been described methods and apparatus for simply and precisely positioning one or more of several selected driven members including means for providing a novel compliant yet precise drive, and also a unique positioning control that may employ brakes inherently forming part of a remote dual drive selector.

The foregoing detailed description is to be clearly understood as given by way of illustration and example only, the spirit and scope of this invention being limited solely by the appended claims.

What is claimed is:

1. Positioning apparatus for a movable device comprising command means for generating a position error signal indicative of the distance between a position to which said device is to be moved and the actual position of said device, velocity means for generating a velocity signal indicative of the actual velocity of said device, and means responsive to said velocity means and to said command means for applying to said device a braking force substantially proportional to the difference between said velocity signal and said position error signal.

2. The apparatus of claim 1 wherein said command means comprises means for generating a position command signal indicative of a position to which the device is to be moved, pickoff means for generating a position signal indicative of actual position of said device, and means for subtractively combining said command and position signals to produce said position error signal.

3. The apparatus of claim 2 including a motor, connecting means responsive to said motor for driving said device, and means responsive to said means for subtractively combining for driving said motor at a velocity substantially proportioned to said position error signal.

4. The apparatus of claim 3 wherein said connecting means comprises a tension member driven by said motor and connected to drive said device.

5. A servo mechanism comprising a driven member, pickoff means connected to sense motion of the driven member and provide a feedback signal, difference circuit means responsive to said feedback signal and to a command signal for generating a position error signal, and means responsive to both said position error signal and actual motion of said driven member for applying a resistive force to said driven member.

6. The mechanism of claim 5 including a motor, connecting means for driving said driven member in response said motor, and means responsive to said difference circuit means for operating said motor in accordance with said position error signal.

7. Dual driving apparatus comprising a drive member, first and second driven members, first and second coupling means for driving said driven members respectively in response to said drive member, means for applying a predetermined restraint to said first driven member, means for actuating said drive member to thereby direct motion of said second driven member, and means for applying to said second driven member a restraint that tends to decrease the difference between actual rate of motion of said second driven member and its distance from a predetermined position.

8. The apparatus of claim 7 including means for applying a predetermined restraint to said second driven member thereby to cause said first driven member to move in response to said drive member, and means for applying to said first driven member a retraint that tends to decrease the difference between actual rate of motion of said first driven member and its distance from a predetermined position.

9. The apparatus of claim 7 wherein said means for applying a restraint to said second driven member comprises means for generating a command signal representative of said distance of said second driven member from a predetermined position, means for generating a velocity signal representative of rate of motion of said second driven member, and means for applying a braking force to said second driven member substantially in proportion to the difference between said command signal and said velocity signal.

10. In a machine drive including a motor having a driving connection to a driven member and closed loop control means for actuating the motor at a command velocity corresponding to the difference between actual and desired positions of said driven member, the improvement comprising means for applying a second force to said driven member in accordance with the difference between said command velocity and the actual velocity of said driven member.

11. The improvement of claim 10 wherein said second force is applied in a sense to decrease said actual velocity when said command velocity decreases.

12. The improvement of claim 10 wherein said means for applying a second force comprises forcing means and high gain feedback circuit means for energizing said forcing means, said circuit means comprising means for sensing actual velocity of said driven member and error means for comparing said sensed actual velocity with said command velocity and energizing said forcing means in accordance with the difference therebetween.

13. The improvement of claim 12 wherein said means for applying a second force to said driven member comprises a proportional brake responsive to said error means and connected to restrain motion of said driven member.

14. A control system comprising a driven member, a motor, means for feeding a first control signal to said motor to drive said motor at a variable motor command rate, drive means coupled between said motor and member for driving said member at a variable member rate, wherein said member rate may differ from said motor command rate, and means for opposing motion of said driven member in accordance with the difference between said member rate and said motor command rate.

15. The system of claim 14 wherein said means for feeding a first control signal comprises a servo loop including a source of command signal, pickoff means responsive to motion of said member for generating a feedback signal, and error means responsive to said feedback and command signals for generating said first control signal, and wherein said means for opposing motion of said driven member comprises a second servo loop including braking means for braking said member, second error means responsive to motion of said member and to said first control signal for generating a second control signal, and means for energizing said braking means in accordance with said second control signal.

16. The system of claim 14 wherein said first control signal is proportional to the distance of said driven member from a desired position and wherein said means for opposing motion of said driven member comprises brake means for applying a braking force to said driven member in proportion to the difference between the actual rate of said driven member and said first control signal.

17. The system of claim 16 wherein said drive means comprises a tension member.

18. The method of positioning a movable member comprising the steps of detecting the distance of said member from a predetermined position, detecting velocity of said member, and applying to said member a braking force substantially proportional to the difference between said detected distance and said detected velocity.

19. The method of claim 18 including coupling a driving motor to said member and operating said motor at a speed proportional to said detected distance.

20. The method of claim 18 including operating a motor at a speed in accordance with said detected distance, connecting a tension member to said driven member, and causing said motor to pull said tension member and thereby to pull said driven member.

21. Dual driving apparatus comprising a drive member, first and second driven members, first and second coupling means for driving said driven members, respectively, in response to said drive member, drive selector means for selectively differentially restraining one or the other of said driven members to thereby relatively increase the response to said drive member of that one of said driven members under lesser restraint, means for driving said drive member, said means for driving said drive member comprising a motor, means for connecting said motor to said drive member, closed loop control means for actuating said motor at a desired velocity, and braking means for applying a retarding force to one of said driven members in accordance with the difference between said desired velocity and the velocity of said one driven member.

22. The apparatus of claim 21 wherein said drive selector means includes said braking means.

23. The apparatus of claim 21 wherein said means for connecting said motor to said drive member comprises a loose driving connection between said motor and said drive member, said closed loop control means comprising first and second difference circuit means respectively responsive to commanded and actual positions of said first and second driven members for respectively generating first and second motor speed control signals, means responsive to said motor speed control signals for actuating said motor, said drive selector means comprising second braking means for applying a retarding force to the other of said driven members in accordance with the difference between one of said motor speed control signals and actual velocity of said other driven member.

24. In a bending machine having a body and a bending head mounted on the body for bending an elongated workpiece presented to the bending head at selected axial and rotational positions of the workpiece, improved apparatus for presenting the workpiece to the bending head comprising a track mounted on the machine body, a carriage mounted for motion to and along said track, a work holding chuck rotatably mounted upon said carriage, a drive sprocket journalled on the carriage, motion transmitting means interconnected between the chuck and the drive sprocket for rotating the chuck in response to rotation of the sprocket, first brake means mounted on the carriage for selectively resisting rotation of the chuck, second brake means mounted on the carriage for selectively resisting motion of the carriage along the track, a drive chain movably mounted upon the track and engaged with said drive sprocket, means for selectively actuating said first and second brake means to selectively drive said carriage or said chuck in response to motion of said drive chain, means for generating a first commanded position error, means for generating second commanded position error, means for energizing said first brake means to apply a restraint against rotation of said chuck in accordance with the difference between said second commanded position error and rotational velocity of said chuck, and means for energizing said second brake means to apply a restraint against motion of said carriage in accordance with the difference between actual velocity of said carriage and said first commanded position error.

25. The bending machine of claim 24 including a motor connected to drive said chain along said track, and means for driving said motor at a speed proportional to one of said commanded position errors.

26. The bending machine of claim 25 including multiplexing means for coupling said motor to be driven by said first commanded position error when said second brake means is energized to apply restraint against motion of said carriage that varies in accordance with the difference between actual velocity of said carriage and said first commanded position error, and for coupling said motor to be driven by sid second commanded position error when said first brake means is energized to apply restraint against rotation of said chuck that varies in accordance with the difference between said second commanded position error and actual chuck rotational velocity.

27. A bending machine comprising a machine body, bending head means mounted adjacent said body for bending an elongated workpiece presented thereto, and means for presenting an elongated workpiece to the bending head means at selected axial and rotational positions of the workpiece, said means for presenting comprising a track mounted on the machine body, a carriage movable on the track, rotatable chuck means journalled on the carriage for grasping and axially rotating a workpiece for presentation to the bending head means, a driven, flexible tension element mounted on said body, drive means coupled with said tension element for independently rotating said chuck means or moving said carriage along said track, and carriage positioning means comprising command means for generating a carriage position error signal indicative of the distance of said carriage from a selected position, pickoff means for detecting velocity of said carriage, brake means for braking motion of said carriage in accordance with a brake control signal, and difference means responsive to said command and pickoff means for applying to said brake means a brake control signal in accordance with the difference between said position error signal and said velocity.

28. The bending machine of claim 27 including means for braking rotation of said chuck in accordance with the difference between distance of said chuck from a selected position and rotational velocity of said chuck.

* * * * *

UNITED STATES PATENT AND TRADEMARK OFFICE

CERTIFICATE OF CORRECTION

PATENT NO. 3,949,582

DATED April 13, 1976

INVENTOR(S) : Homer L. Eaton, Walter F. Felber

It is certified that error appears in the above-identified patent and that said Letters Patent are hereby corrected as shown below:

Col. 1, lines 9, 10: delete "invention, and the disclosure thereof is fully incorporated herein by this".

Col. 4, line 14: change "band" to --bend--.

Col. 4, line 26: after "housing" insert--40--.

Col. 7, line 18: change "separated" to --operated--.

Col. 8, line 13: change "on" to --of--.

Col. 8, line 62: insert --angular-- between "desired (angular) displacement".

Col. 9, line 17: change "different" to --difference--.

Col. 9, line 30: change "different" to --difference--.

Col. 9, line 48: change "different" to --difference--.

Col. 9, line 59: change "different" to --difference--.

Col. 10, line 14: change "different" to --difference--.

Col. 10, line 65: change "provide" to --provided--.

Col. 12, line 20: delete second "the" and insert --with--.

Col. 12, line 26: change "pisition" to --position--.

UNITED STATES PATENT AND TRADEMARK OFFICE

CERTIFICATE OF CORRECTION

PATENT NO. : 3,949,582

DATED : April 13, 1976

INVENTOR(S) : Homer L. Eaton, Walter F. Felber

It is certified that error appears in the above-identified patent and that said Letters Patent are hereby corrected as shown below:

Col. 14, line 8: change "position" to --positioning--.

Col. 16, line 17: change "retraint" to --restraint--.

Col. 18, line 67: delete "sid" and insert --said--.

Signed and Sealed this

Third Day of August 1976

[SEAL]

*Attest:*

RUTH C. MASON
*Attesting Officer*

C. MARSHALL DANN
*Commissioner of Patents and Trademarks*